United States Patent [19]

Anderson

[11] Patent Number: 4,808,027

[45] Date of Patent: Feb. 28, 1989

[54] COMPACTION ATTACHMENT FOR BACKHOE

[75] Inventor: Ronald L. Anderson, Burlington, Iowa

[73] Assignee: J. I. Case Company, Racine, Wis.

[21] Appl. No.: 112,412

[22] Filed: Oct. 26, 1987

[51] Int. Cl.[4] ..... E01C 19/23

[52] U.S. Cl. ..... 404/127; 404/121; 404/128; 37/DIG. 12; 37/117.5; 172/771

[58] Field of Search ..... 404/121, 124, 127, 128, 404/133, 96; 37/117.5, DIG. 3, DIG. 12; 172/387, 764, 765, 771; 180/20

[56] References Cited

U.S. PATENT DOCUMENTS

| | | | |
|---|---|---|---|
| 3,581,924 | 6/1971 | Marz | 37/117.5 X |
| 3,595,411 | 7/1971 | Ables | 404/121 X |
| 3,891,342 | 6/1975 | Roe | 404/127 X |
| 3,989,404 | 11/1976 | Burton | 404/127 X |
| 4,100,688 | 7/1978 | Grist | 404/127 X |
| 4,278,368 | 7/1981 | Livesay | 404/121 X |
| 4,279,085 | 7/1981 | Arnold | 37/117.5 X |
| 4,521,980 | 6/1985 | Solaja | 37/117.5 |

FOREIGN PATENT DOCUMENTS

| | | | |
|---|---|---|---|
| 166726 | 1/1965 | U.S.S.R. | 404/133 |
| 718525 | 2/1980 | U.S.S.R. | 404/121 |
| 876822 | 10/1981 | U.S.S.R. | 404/133 |

*Primary Examiner*—Stephen J. Novosad
*Assistant Examiner*—John F. Letchford
*Attorney, Agent, or Firm*—Peter N. Jansson

[57] ABSTRACT

An improved simplified compacting apparatus for mounting on the tool-support boom of a backhoe or other tractor. The apparatus includes a lower member with a convex cylindrical compacting surface which extends through an arc of less than about 180 degrees, preferably less than about 90 degrees, and terminates in front and rear edges. At least one and preferably two upright members are secured to the lower member, preferably to a top concave surface thereof, and pivot mounts are on the upright member to allow pivoting attachment to a tool-support boom. The apparatus is easy to operate and easily reaches edges not reached by many prior devices.

15 Claims, 2 Drawing Sheets

COMPACTION ATTACHMENT FOR BACKHOE

FIELD OF THE INVENTION

This invention is related generally to earth-working equipment and, more particularly, to compacting apparatus of the type which are on tractor tool-support booms and have cylindrical compacting surfaces.

BACKGROUND OF THE INVENTION

Ground compaction is required in many different situations. In many cases, compaction of horizontal surfaces is often required at the bottoms of trenches or excavations. Many different kinds of equipment have been developed for ground compaction, including a variety of compacting devices of the type which are supported on tractor tool-support booms and have a cylindrical compacting surface for application to the ground.

Examples of prior devices of this general type include those disclosed in the following U.S. Pat. Nos. 4,100,688 (Grist), 4,278,368 (Livesay), 3,595,411 (Ables), 3,891,342 (Roe) and 3,989,404 (Burton).

Many such devices of the prior art have significant problems and disadvantages, including some which are apparent in certain very common compaction tasks.

One principal problem is that compaction operations cannot be carried out by such prior devices along certain edges of the horizontal surfaces of a trench or excavation bottom, or whenever a vertical obstacle is immediately adjacent to the edge area to be compacted. For example, when the backhoe or other tool-carrying device is facing the trench wall or excavation wall, the cylindrical compacting surface usually cannot be applied, or applied effectively, to the edge of the horizontal surface—next to such wall. Compaction along an edge may be possible when the approach is made along the edge rather than toward it, but certain equipment of the prior art is inadequate when the edge is approached at an angle across the edge.

Edge compaction, at least even edge compaction, is difficult with certain prior equipment even when there is no vertical obstacle along the edge. And, such prior compaction equipment is also frequently inadequate for compaction at the bottoms of small excavations or holes.

Many such prior compaction devices are also extremely complex in structure and operation. In some cases, when not in use, they may interfere with normal backhoe bucket operations. Furthermore, due to their complexity they are often expensive.

It can be seen that prior backhoe-mounted cylindrical compaction tools have significant problems. There clearly is a need for an improved compacting apparatus of the type on a tractor tool-support boom.

OBJECTS OF THE INVENTION

It is an object of this invention to provide an improved compaction apparatus overcoming some of the problems and shortcomings of the prior art, including those mentioned above.

Another object of this invention is to provide an improved compaction apparatus of the type mountable on a tractor tool-support boom and having a cylindrical compacting surface for application to the ground.

Another object of this invention is to provide an improved compacting apparatus with greater ability to compact edge areas, including edge areas adjacent to vertical obstacles.

Another object of this invention is to provide a highly versatile compacting apparatus which may be used successfully not only in ground-level compacting, but in compacting within both small holes and large holes.

Another object of this invention is to provide an improved compacting apparatus which is simple in construction an easily operated.

These and other important objects will be apparent from the descriptions of this invention which follow.

SUMMARY OF THE INVENTION

This invention is an improved compacting apparatus of the type including a backhoe or other tractor tool-support boom, and having a cylindrical compacting member for application to the ground. This invention overcomes certain problems associated with such prior devices.

The compacting member forming part this invention is attached to a backhoe or similar device in place of a backhoe bucket, with attachment normally being made to the boom arm and the tilt arm of such devices. The apparatus is manipulated by the hydraulic controls used to manipulate a backhoe bucket.

The improved compacting member of this invention includes a lower member having a convex cylindrical compacting surface which is considerably less than a complete cylinder. The convex cylindrical compacting surface of the lower member of the apparatus of this invention extends through an arc of less than about 180 degrees and terminates in front and rear edges. At least one upright member is secured to the lower member, and pivot-mounting means are on the upright member(s) to provide means for attachment to tool-support arms.

The term "cylindrical" as used herein refers to any curved surface of the type generated by a substantially straight line which remains parallel to a fixed straight line while constantly intersecting a given curve having no inflection points other than possibly at its ends.

The compacting apparatus preferably has at least one forward pivot means and at least one rearward pivot means. A pair of forward pivot means and a pair of rearward pivot means are highly preferred. A forward pivot means and a rearward pivot means are preferably in each of two upright members.

Each forward pair of pivot means is preferably a pair of aligned circular openings which can receive a pivot mounting pin as means for attachment to the tilt arm, which is controlled by what is sometimes referred to as the backhoe bucket cylinder. Each rearward pair of pivot means is preferably a pair of aligned circular openings which can receive a pivot mounting pin as means for attachment to the boom arm, which is controlled by what is sometimes referred to as the backhoe dipper cylinder.

The preferred two upright members are laterally spaced upright members extending from the lower member in a direction away from the compacting surface. They are preferably parallel plates each along a line which extends between the front and rear edges. The upright plates themselves preferably extend from the front edge of the lower member to the rear edge of the lower member.

The lower member preferably has a concave top surface opposite and parallel to the convex compacting surface, and the parallel upright plates are preferably attached to such concave top surface all the way from the front edge to the rear edge of the lower member to add structural strength to the apparatus.

The compacting apparatus of this invention is easy to operate and simple in construction. It is operated simply by applying the apparatus, more specifically, its cylindrical compacting surface, to the ground or other material to be compacted, then applying a degree of down pressure to the ground by movement of the backhoe boom, and then rocking the convex cylindrical surface on the ground by using the dipper and bucket controls of the backhoe (or similar device). A rocking motion similar to a rocking chair allows compaction to proceed easily and successfully. More specifically, the rocking motion results from extending the hydraulic control arm for the bucket while retracting the hydraulic control arm for the dipper, and vice versa.

One very specific and important advantage of this invention is that it is able to reach quite easily edges which are normally rather inaccessible to backhoe-mounted compactors of the type having cylindrical compacting surfaces. Edges along vertical obstacles, such as certain edges at the bottom of trenches, which cannot be easily reached by devices of the prior art may readily be reached by the apparatus of this invention.

Such edge compacting is done by orienting the lower member such that its front edge is in a down position, that is, a position at least as low or nearly as low as other portions of the cylindrical compacting surface, and then moving the compacting apparatus against such edge, applying downward pressure, and beginning the rocking motion. The compacting apparatus of this invention forms a void segment adjacent to and forward of the front edge which is free of support structure, the front edge forming the forwardmost part of the compacting apparatus. Thus, edges may be compacted when the backhoe is oriented toward such edges, rather than just along such edges.

It is highly preferred that the convex cylindrical compacting surface of the lower member of the apparatus of this invention extend through an arc of less than about 90 degrees. Such shorter cylindrical sections further facilitate the edge compacting near vertical obstacles, as described above.

As with many other compacting devices of the type having a cylindrical compacting surface, the compacting surface of the apparatus of this invention has an array of teeth protruding from it. Such teeth may be arranged and spaced in any desirable fashion.

The compacting apparatus of this invention can be used not only for compaction, but also for pulling dirt toward a surface on which it is to be compacted. For example, by extending the compacting apparatus over a pile of dirt and orienting the compacting apparatus with its rear edge down such that the top surface of its lower member is toward the operator, the top surface of the compacting apparatus can move the dirt toward a trench or other hole which is between the compacting apparatus and the operator. Then, after such dirt is in the trench it can be compacted in the manner described above, such compaction being readily performed even at the edge of the trench bottom.

The compacting apparatus of this invention is useful for a great variety of compacting tasks, including compacting in trench bottoms, excavations, large holes, small holes, and for that matter on ground-level surfaces.

DETAILED DESCRIPTIONS OF PREFERRED EMBODIMENTS

Figure 1:
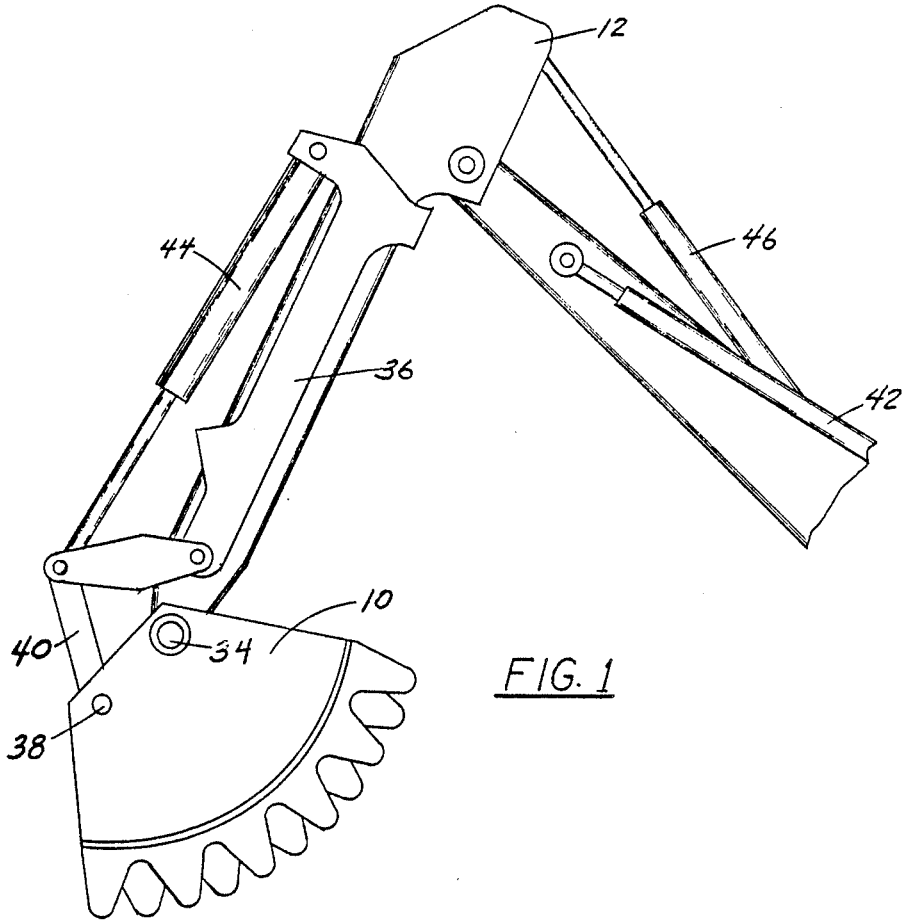
FIG. 1 a side elevation of a compacting apparatus in accordance with this invention, attached to a backhoe.

The figures illustrate a preferred compacting apparatus in accordance with this invention, having a compacting member 10. As shown, compacting apparatus 10 is attachable to a backhoe, in a manner hereafter described.

Compacting member 10 includes a lower member 14, a pair of upright members 16, and forward and rearward circular openings 18 and 20 which provide means for pivoting attachment of member 10 to backhoe 12. Compacting member 10 is a rigid metal structure, its parts being of heavy steel plates. Lower member 14 and upright members 16 are welded together in a manner providing excellent structural strength.

Lower member 14 is made of cast or bent metal plate and has a convex cylindrical compacting bottom surface 22 and an opposite concave top surface 24. Lower member 14 also includes a number of parallel tooth plates 26 which are welded in offset parallel fashion to convex compacting surface 22. Teeth 26 may be in a variety of shapes and sizes, as is well known in devices of the prior art.

Convex cylindrical compacting surface 22 extends through an arc of less than 180 degrees; indeed, it extends through an arc of less than about 90 degrees. Cylindrical surface 22 terminates in front and rear edges 28 and 30. Front and rear edges 28 and 30 parallel and are substantially normal to the side edges 32 of lower member 14.

Upright members 16 are a pair of spaced parallel plates which extend from top surface 24 of lower member 14 in a direction away from compacting surface 22. Upright members 16 are laterally spaced and each extends all the way from front edge 28 to rear edge 30 and is attached to top surface 24 by welding all along its juncture with lower member 14. Such attachment provides additional structural strength for compacting member 10, and in some cases may allow the use of metal plates of somewhat lesser thickness than would otherwise be possible.

Each upright member 16 has a forward circular opening 18 and a rearward circular opening 20. The forward circular openings 18 in upright members 16 are in axial alignment with each other, and the rearward circular openings 20 are in axial alignment with each other. The spacing of forward circular openings 18 from rearward circular openings 20 is such that operation of the dipper cylinder and bucket cylinder will impart a rocking motion, as hereafter described, to compacting member 10.

A pivot-mounting pin 34 extends through rearward circular openings 20 and an opening in the end of backhoe boom arm 36 to connect compacting member 10 with boom arm 36. Likewise, a pivot-mounting pin 38 extends through forward circular openings 18 and an opening in lift arm 40 to connect compacting member 10 with lift arm 40.

Operation of compacting apparatus 10 is as follows:

The extension of boom cylinder 42 serves to move compacting member 10 in a generally downward direction—toward the ground. After compacting member has been applied to the ground in this manner, extension of bucket cylinder 44 and retraction of dipper cylinder 46 serve to rock compacting member 10 such that front edge 28 moves toward the ground while rear edge 30 moves away from the ground. Likewise, retraction of bucket cylinder 44 and extension of dipper cylinder 46 causes a rocking action in the opposite direction, such that rear edge 30 moves toward the ground while front edge 28 moves away from the ground.

Alternately repeating such actions causes a rocking motion which, given that compacting member 10 is applied firmly to the ground by virtue of the position of boom cylinder 42, provides an excellent compacting action.

Compacting member 10 is simple and inexpensive in construction and may be installed or removed easily from backhoe 12. In operation, the compacting apparatus of this invention provides a great deal of versatility not available in many prior art devices which are more complex and expensive.

Figure 4:
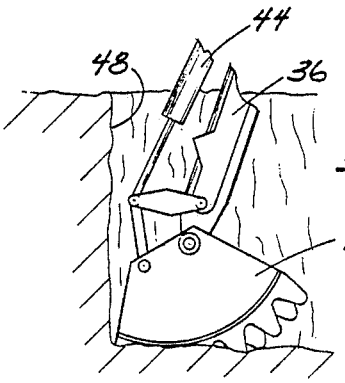
FIG. 4 is a schematic view illustrating use of the compacting apparatus of this invention along the edge of the trench.
Figure 2:
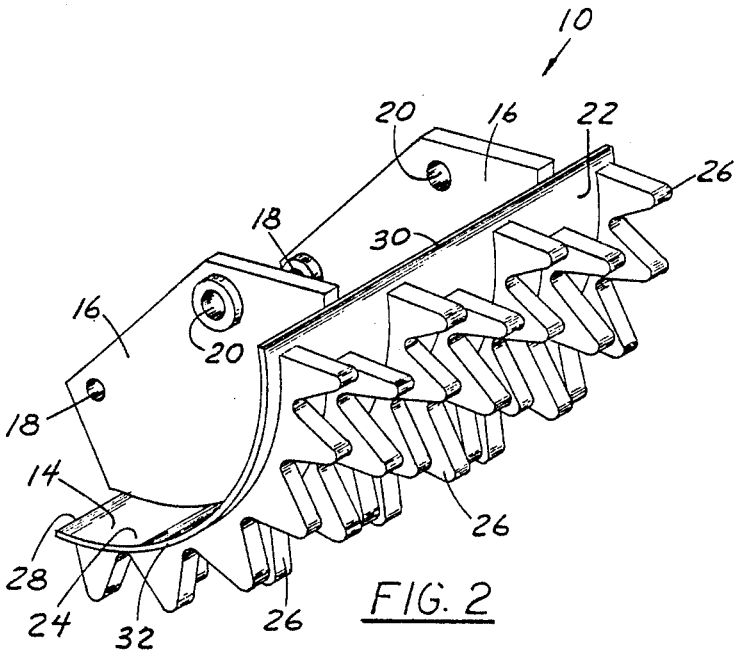
FIG. 2 is a perspective view of the compacting apparatus of FIG. 1.
Figure 3:
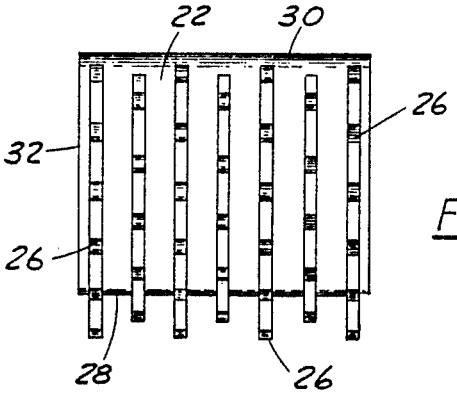
FIG. 3 is a front view of FIG. 2.

For example, as illustrated in FIG. 4, this invention can be used to compact ground at the base of a trench immediately along the edge of a vertical wall 48 which is opposite the position of the operator of backhoe 12. This is done in the manner previously described. The compacting apparatus of this invention is also very useful for accurate compacting at the bottom of small holes, not readily accessible by equipment of the prior art.

While the principles of this invention have been described in connection with specific embodiments, it should be understood clearly that these descriptions are made only by way of example and are not intended to limit the scope of the invention.

What is claimed is:

1. In a compacting apparatus of the type including a tractor tool-support boom and a cylindrical compacting member for application to the ground, the improvement comprising:

the cylindrical compacting member having a lower member with a convex cylindrical compacting surface with extends through an arc of less than about 180 degrees and in front and rear edges, the front edge being transverse to said boom;

at least one upright member secured to the lower member;

pivot-mounting means on the upright member(s), such pivot-mounting means in rigid fixed position with respect to the convex cylindrical compacting surface and providing means for attachment to a tool-support boom; and said compacting apparatus forming a void segment adjacent to and forward of the front edge, said void segment being free of support structure, whereby edge compaction adjacent to vertical obstacles in front of the boom is facilitated.

2. The compacting apparatus of claim 1 wherein the pivot-mounting means comprises at least one forward pivot means and at least one rearward pivot means.

3. The compacting apparatus of claim 2 wherein the forward pivot means comprise(s) a pair of forward pivot means and the rearward pivot means comprise(s) a pair of rearward pivot means.

4. The compacting apparatus of claim 3 wherein each such pair of forward pivot means and each such pair of rearward pivot means comprises a pair of aligned circular openings in the upright members, whereby each aligned pair of openings may receive a pivot-mounting pin.

5. The compacting apparatus of claim 3 wherein the pivot-mounting means comprises a forward and a rearward pivot means in each upright member.

6. The compacting apparatus of claim 5 wherein each such pair of forward pivot means and each such pair of rearward pivot means comprises a pair of aligned circular openings in the upright members.

7. The compacting apparatus of claim 3 wherein the upright member comprise(s) a pair of laterally spaced upright members extending from the lower member in a direction away from the compacting surface.

8. The compacting apparatus of claim 7 wherein the laterally spaced upright members are parallel plates each along a line which extends between the front and rear edges.

9. The compacting apparatus of claim 8 wherein the pivot-mounting means comprises a forward and a rearward pivot means in each upright member.

10. The compacting apparatus of claim 9 wherein each such pair of forward pivot means and each such pair of rearward pivot means comprises a pair of aligned circular openings in the upright members.

11. The compacting apparatus of claim 8 wherein the parallel plates extend from the front edge to the rear edge of the lower member.

12. The compacting apparatus of claim 11 wherein:

the lower member has a concave top surface opposite and parallel to the convex compacting surface; and the parallel plates are attached to the concave top surface from the front edge to the rear edge, thereby adding structural strength to the apparatus.

13. The compacting apparatus of claim 12 wherein the pivot-mounting means comprises a forward and a rearward pivot means in each upright member.

14. The compacting apparatus of claim 13 wherein each such pair of forward pivot means and each such pair of rearward pivot means comprises a pair of aligned circular openings in the upright members.

15. The compacting apparatus of claim 1 wherein the convex cylindrical compacting surface extends through an arc of less than about 90 degrees, thereby further facilitating edge compacting near vertical obstacles.

* * * * *

UNITED STATES PATENT AND TRADEMARK OFFICE

CERTIFICATE OF CORRECTION

PATENT NO. : 4,808,027

DATED : February 28, 1989

INVENTOR(S) : Ronald L. Anderson

It is certified that error appears in the above-identified patent and that said Letters Patent is hereby corrected as shown below:

Column 2, line 9, change "an" to --and--.

Column 4, line 16, change "apparatus" to --member--.

Column 4, line 39, change "30 parallel" to --30 are parallel--.

Column 5, line 1, delete "10".

Column 5, line 5, insert --10-- as the first word of the line.

Claim 1, line 7, change "with" to --which--.

Claim 1, line 8, after "and" insert --terminates--.

Signed and Sealed this

Twenty-ninth Day of August, 1989

*Attest:*

DONALD J. QUIGG

*Attesting Officer*

*Commissioner of Patents and Trademarks*